US009404708B1

(12) United States Patent
Chow et al.

(10) Patent No.: US 9,404,708 B1
(45) Date of Patent: Aug. 2, 2016

(54) STOCK FOR A FIREARM

(71) Applicant: Magpul Industries Corp, Louisville, CO (US)

(72) Inventors: Eric Chow, Highlands Ranch, CO (US); Turner Sessions, Lafayette, CO (US)

(73) Assignee: MAGPUL INDUSTRIES CORP., Louisville, CO (US)

( * ) Notice: Subject to any disclaimer, the term of this patent is extended or adjusted under 35 U.S.C. 154(b) by 0 days.

(21) Appl. No.: 14/788,025

(22) Filed: Jun. 30, 2015

(51) Int. Cl.
*F41C 23/14* (2006.01)
*F41C 23/06* (2006.01)

(52) U.S. Cl.
CPC ..... *F41C 23/14* (2013.01); *F41C 23/06* (2013.01)

(58) Field of Classification Search
CPC ..... F41C 23/04; F41C 23/06; F41C 23/08; F41C 23/14
USPC ..... 42/73, 74
See application file for complete search history.

(56) References Cited

U.S. PATENT DOCUMENTS 6,543,172 B1 4/2003 Armstrong
6,637,141 B1 10/2003 Weatherby et al.
6,688,031 B2 2/2004 Steele
6,874,267 B2 4/2005 Fitzpatrick et al.
7,131,228 B2 11/2006 Hochstrate et al.
7,152,355 B2 12/2006 Fitzpatrick et al.
7,162,822 B1 * 1/2007 Heayn ..... F41C 23/04 42/71.01
7,363,740 B2 4/2008 Kincel
7,640,688 B2 1/2010 Oz
7,673,413 B2 3/2010 Bentley
7,762,018 B1 7/2010 Fitzpatrick et al.
7,823,313 B2 11/2010 Faifer
7,849,626 B2 * 12/2010 Fluhr ..... F41C 23/04 42/73
7,937,873 B2 5/2011 Keng
7,984,580 B1 7/2011 Giauque et al.
8,051,593 B2 11/2011 Vesligai
8,087,193 B2 1/2012 Kincel
8,127,483 B2 3/2012 Kincel
D661,366 S 6/2012 Zusman (Continued)

FOREIGN PATENT DOCUMENTS

CA 2653729 A1 12/2007
DE 202008000829 U1 6/2009

(Continued)

OTHER PUBLICATIONS

Bravo Company USA Inc., "BCMGUNFIGHTER Stock Assembly—Black", Webpage found at http://www.bravocompanyusa.com/BCM-GUNFIGHTER-s-Stock-Mod-0-Black-p/bcm-gfs-mod-0-blk.htm Inventor(s) aware of prior art on or before May 20, 2015, p. 4, Published in: US.

(Continued)

*Primary Examiner* — Stephen M Johnson
(74) *Attorney, Agent, or Firm* — Neugeboren O'Dowd PC

(57) ABSTRACT

A stock for a firearm is disclosed. The stock has a length of pull (LOP) adjustment mechanism. The LOP adjustment mechanism is biased towards an engaged configuration and is movable to a disengaged configuration. A locating member protrudes into a stock mounting space and a first arm is in an engagement position when the LOP adjustment mechanism is in the engaged configuration. The locating member is translated such that the locating member does not protrude into the mounting space and the first arm is pivoted into a disengagement position when the LOP adjustment mechanism is in the disengaged configuration.

20 Claims, 15 Drawing Sheets

(56) References Cited

U.S. PATENT DOCUMENTS

| | | | |
|---|---|---|---|
| 8,191,299 | B2 | 6/2012 | Faifer |
| D668,311 | S | 10/2012 | Rogers et al. |
| 8,327,569 | B2 | 12/2012 | Kincel |
| 8,341,868 | B2 | 1/2013 | Zusman |
| 8,381,427 | B2 | 2/2013 | Nill |
| 8,387,298 | B2 | 3/2013 | Kincel |
| 8,397,414 | B2 | 3/2013 | Walters |
| 8,434,252 | B2 | 5/2013 | Holmberg |
| 8,555,541 | B2 | 10/2013 | Ingram |
| D697,162 | S | 1/2014 | Faifer |
| 8,720,099 | B1 | 5/2014 | Sisk |
| 8,782,941 | B2 | 7/2014 | Zusman |
| 8,844,185 | B2 | 9/2014 | Jarboe |
| D722,357 | S | 2/2015 | Keller et al. |
| D722,669 | S | 2/2015 | Keller |
| 8,943,728 | B2 | 2/2015 | Ward et al. |
| 8,950,099 | B2 | 2/2015 | Rogers et al. |
| 8,955,245 | B2 | 2/2015 | Chvala |
| 8,978,284 | B1 | 3/2015 | Zusman |
| 8,978,285 | B1 | 3/2015 | Burke et al. |
| 8,984,791 | B1 | 3/2015 | Leslie |
| 2012/0174455 | A1 | 7/2012 | Edelman et al. |
| 2013/0097911 | A1 | 4/2013 | LaRue |
| 2014/0190056 | A1 | 7/2014 | Troy et al. |

FOREIGN PATENT DOCUMENTS

| | | | |
|---|---|---|---|
| EP | 2080980 | A2 | 7/2009 |
| WO | 2012050670 | A2 | 4/2012 |
| WO | 2014011133 | A1 | 1/2014 |
| WO | 2014078462 | A1 | 5/2014 |

OTHER PUBLICATIONS

Command Arm Accessories, "Skeletonized Buttstock—SKBS", Webpage found at http://store.commandarms.com/skeletonized-buttstock-skbs/ Inventor(s) aware of prior art on or before May 20, 2015, p. 2.

Damage Industries, "Stock, Enhanced Combat System", Webpage found at http://damageindustriesllc.com/product/stock-enhanced-combat-system Inventor(s) aware of prior art on or before May 20, 2015, p. 2.

FAB Defense, "GLR-16—AR15/M16 Buttstock", Webpage found at http://www.fab-defense.com/en/category-buttstocks/id-8/ar15-m16-buttstock.html Inventor(s) aware of prior art on or before May 20, 2015, p. 1.

MFT, "Battelink Utility Stock Series", Webpage found at http://missionfirsttactical.com/Products/Rifle-Stocks Inventor(s) aware of prior art on or before May 20, 2015, p. 4.

MFT, "MFT Battelink Minimalist Stock Review", Webpage found at https://www.youtube.com/watch?v=NIMXZJbnfbs Inventor(s) aware of prior art on or before May 20, 2015, p. 2.

Rogers Shooting School, "Rogers Super-Stoc", Webpage found at http://www.rogersshootingschool.com/products/superstoc.php Inventor(s) aware of prior art on or before May 20, 2015, p. 3.

* cited by examiner

STOCK FOR A FIREARM

FIELD OF THE DISCLOSURE

The present disclosure relates generally to firearms. In particular, but not by way of limitation, the present disclosure relates to collapsible stocks for firearms.

BACKGROUND OF THE INVENTION

Collapsible stocks for firearms historically have a noticeable amount of tolerance, rattle, or relative movement between the stock and a receiving member, such as a receiver extension or adapter, of the firearm. This has typically been accepted by manufacturers in the industry providing aftermarket stocks intended for use with a variety of firearms, because the manufacturers provide stocks that accommodate the differences in standards that, even where purportedly working from the same pattern, do not necessarily adhere to the tolerance standards of the particular pattern. For example, even within a single pattern from a single manufacturing entity, movement of the stock relative to the receiving member of the firearm may reach an unacceptable level at the extremes of the manufacturing tolerances for the firearm, including the receiving member of the firearm (e.g. receiver extension or adapter) and the stock.

An undesirable amount of movement or rattle can adversely affect stability and accuracy of the firearm to which the stock is mounted, and, importantly, affect the perception of quality of the stock and firearm even if the accuracy is not affected. Over time, the relative movement can lead to damage to the stock and/or the firearm in some cases. Some in the industry have developed a variety of stabilizing mechanisms; however, currently-available designs are quite expensive and/or not suited for the retail consumer.

For example, U.S. Pat. No. 8,555,541, issued on Oct. 15, 2013 to Ingram (hereinafter "the '541 patent") discloses a removable butt stock with two anti-rattle springs mounted within the receiver bore that press against the buffer tube to securely hold it in place within the receiver bore and prevent any potential rattle or shimmy (see FIG. 7 of the '541 patent). While functional, the invention disclosed in the '541 patent requires the use of springs that double the cost of manufacturing the stock. In some cases, the springs may damage the buffer tube or receiving member.

U.S. Pat. No. 8,191,299, issued on Jun. 5, 2012 to Faifer (hereinafter "the '299 patent"), also attempting to mitigate relative movement between the stock and the receiver extension, discloses a stock with a buffer tube holder having one or two buffer tube support members. The support members are flaps defined by a U-shaped slot. While functional as an anti-rattle feature, the flaps pose at least two problems. First, the flaps are always in an engaged position, so that, when the user assembles, disassembles, and/or adjusts the stock, the flaps cause friction on the stock, potentially resulting in unsmooth movement between the stock and the buffer tube. Moreover, after the stock is left installed on the buffer tube for an extended period of time, as can be expected under normal use, the flaps disclosed in the '299 patent are subject to creep, resulting in a loosening of the flaps from engagement with the buffer tube and a degradation or loss of the anti-rattle feature.

There therefore remains a need in the industry for a collapsible stock that provides an anti-rattle feature using fewer parts than those currently-available in the industry, while also being suited for use with a variety of manufacturing tolerance standards, and that will retain functionality and tight fitment over extended periods of time.

SUMMARY

Some embodiments disclosed herein address the above stated needs by providing a stock for a firearm.

The stock has a proximal end shaped to allow a user to brace the stock, a distal end shaped to interface with a firearm, and a longitudinal axis fixed by a firing direction of the stock and extending between the proximal end and the distal end of the stock. In some aspects, the stock has a housing including a mounting space along the longitudinal axis, the mounting space shaped to slidingly engage the firearm and having a lower portion with a rail, a locating member hole, and a first lever arm entry. The stock also has a length of pull adjustment mechanism. In some aspects, the length of pull adjustment mechanism includes a locating member translatable along an axis of the locating member hole in the housing. The length of pull adjustment mechanism may include a first lever having a first arm extending from a lever pivot axis through the first lever arm entry and into the mounting space and a second arm extending in a different direction from the lever pivot axis, the first arm shaped to abut the firearm. The length of pull adjustment mechanism may be biased towards an engaged configuration wherein a top portion of the locating member protrudes into the mounting space and the first arm is in an engagement position. The length of pull adjustment mechanism may have a disengaged configuration wherein the locating member is translated such that the upper portion does not protrude into the mounting space, and the first arm is pivoted into a disengagement position.

In some aspects, the length of pull adjustment mechanism is movable between an engaged configuration and a disengaged configuration, wherein the length of pull adjustment mechanism comprises a locating member and a first stabilizer arm. The first stabilizer arm may be movable between an engaged position in the engaged configuration and a disengaged position in the disengaged configuration and shaped to limit transverse movement of the stock relative to a firearm when in the engaged configuration. The first stabilizer arm may be further shaped to cause the locating member to move between an engaged position in the engaged configuration and a disengaged position in the disengaged configuration. The locating member may be shaped to engage a recess in the firearm when in the engaged position to select a length of pull.

In some embodiments, a method of manufacturing a stock for a firearm is provided. The method includes providing a housing having a passage along a longitudinal axis, the passage shaped to slidingly engage a firearm and having a lower portion with a rail, a locating member hole, and a first lever arm entry. The method may also include providing a length of pull adjustment mechanism; wherein the length of pull adjustment mechanism includes a locating member and a first lever having a first arm shaped to abut the firearm and a second arm; and assembling the housing and the length of pull adjustment mechanism. The assembling may include assembling such that the locating member is translatable along an axis of the locating member hole; the first arm of the first lever extends through the first lever arm entry and into the passage; and the second arm of the first lever extends proximally from a transverse lever pivot axis. The assembling may also include assembling such that the length of pull adjustment mechanism is biased towards an engaged configuration wherein a top portion of the locating member protrudes into the passage and the first arm is in an engagement position. The assembling may also include assembling such that the length of pull adjustment mechanism is movable to a disengaged configuration wherein the locating member is translated such that the upper portion does not protrude into the mounting space, and the first arm is pivoted into a disengagement position.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings wherein:

DETAILED DESCRIPTION

The present disclosure relates generally to stocks for firearms, and specifically a stock for a firearm having a length of pull adjustment feature. FIGS. 1-15 illustrate exemplary embodiments or aspects of a stock 100 or making a stock 100 for a firearm that is rooted in the concept of providing an inexpensive stock configured to attach to a multiplicity of firearm patterns while still allowing little to no give or relative movement between the stock 100 and the receiver extension 200 of the firearm. The word "exemplary" is used herein to mean "serving as an example, instance, or illustration." Any embodiment described herein as "exemplary" is not necessarily to be construed as preferred or advantageous over other embodiments. Moreover, while this document generally describes the stock 100 as it attaches to a receiver extension 200, it should be understood that any receiving component of a firearm is intended, such as an adapter for a receiver extension or other features.

Figure 1:
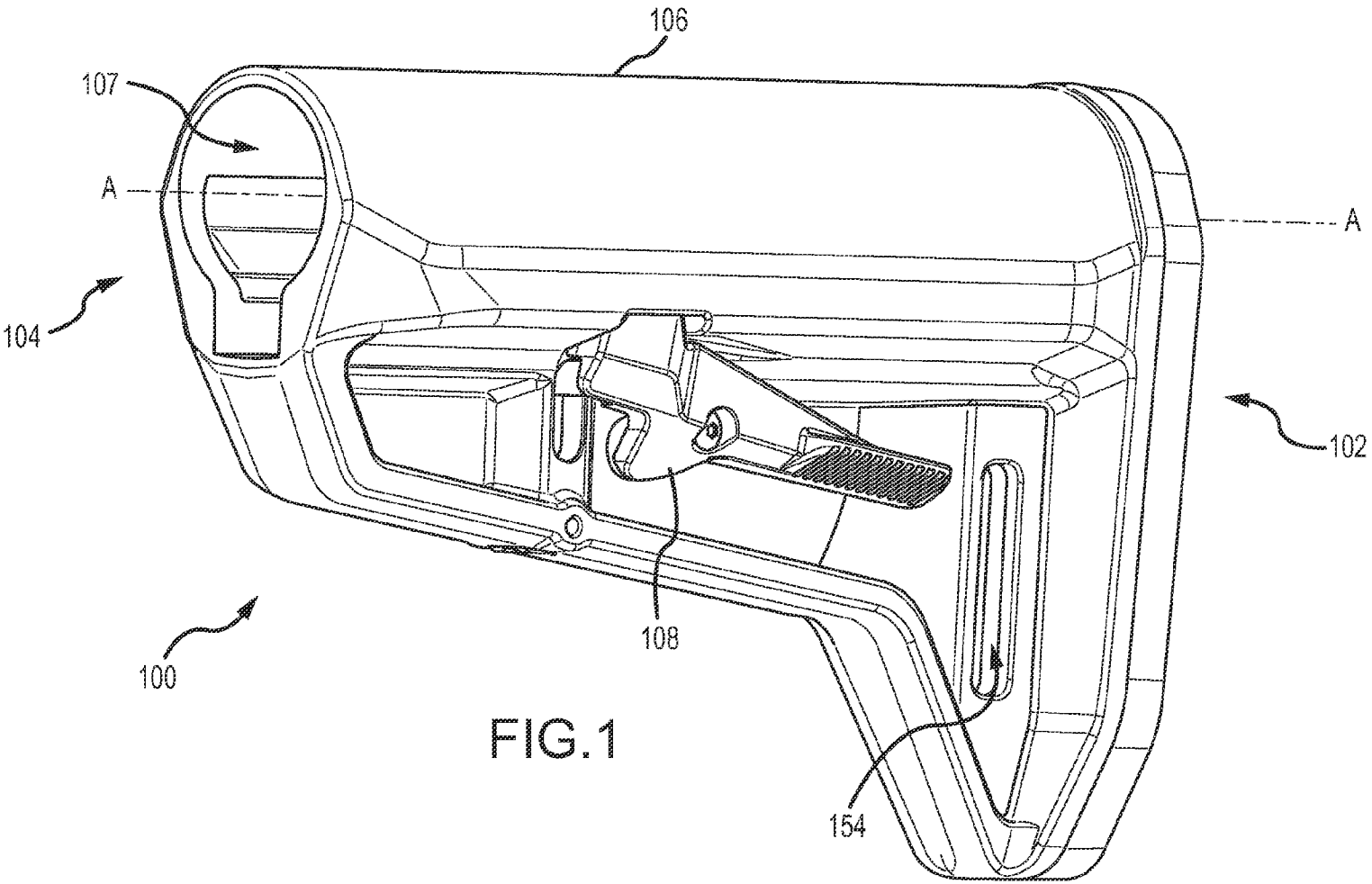
FIG. 1 is a perspective view illustrating some aspects of a stock assembly.
Figure 2:
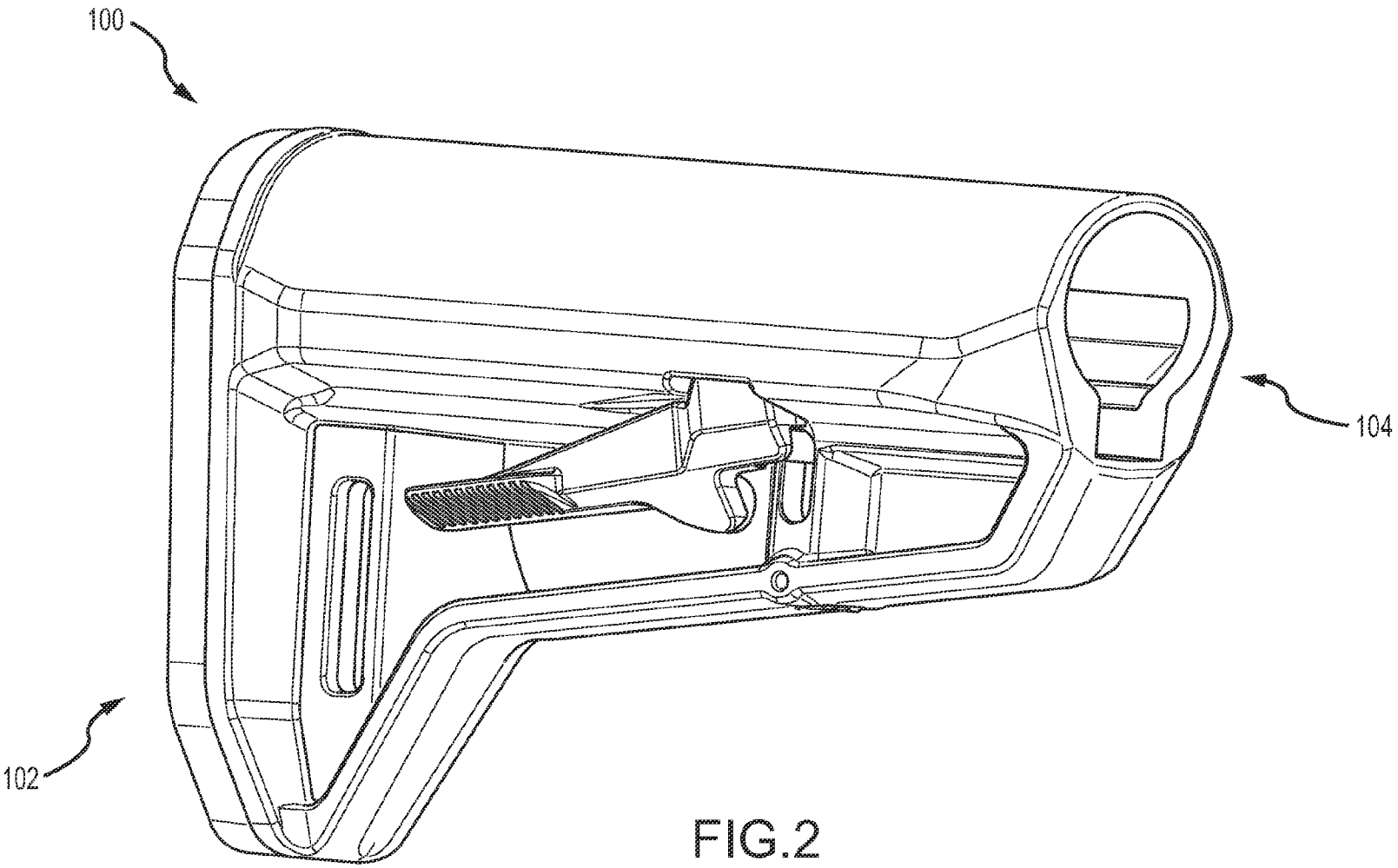
FIG. 2 is a perspective view illustrating some aspects of the stock assembly.

With reference now to FIGS. 1-2, an exemplary stock 100 for a firearm is now described in detail. Generally stated, the stock 100 is assembled with a housing 106 and a length of pull adjustment mechanism 108 or (also referred to as "LOP adjustment mechanism 108" herein). The stock 100 has a proximal end 102 for assisting a user in supporting the stock 100 and a distal end 104 fixed by a firing direction and shaped to interface with a receiver extension 200 of a firearm (see e.g. FIG. 12). A passage 107 in the housing 106 extends between the proximal and distal ends 102, 104 and has a longitudinal axis A fixed by a firing direction of the stock 100. The LOP adjustment mechanism 108 provides a user with the ability to selectively engage the receiver extension 200 (see FIG. 12) at one of a plurality of recesses 208 (see e.g. FIGS. 13-14) in a receiver extension tube 202 to adjust the length of pull of the firearm to suit the user's needs or comfort, including adapting for different types of gear that may affect the length of pull, such as body armor, winter jackets, or adapting for different shooting positions such as a prone verses standing position, or compacting the weapon for storage. For the purpose of this document, the phrase "fixed by a firing direction" is not to be understood as requiring that the direction of fire be parallel or coaxial with the longitudinal axis A, but merely to mean that the axis A is fixed relative to the firing direction, whether by being parallel to, coaxial with, or at an angle to the firing direction.

It should be noted that, although the housing 106 is illustrated with a limited number of optional features known to those skilled in the art, such as a sling mount 154, any number of features now known or unknown in the industry may be included.

Figure 3:
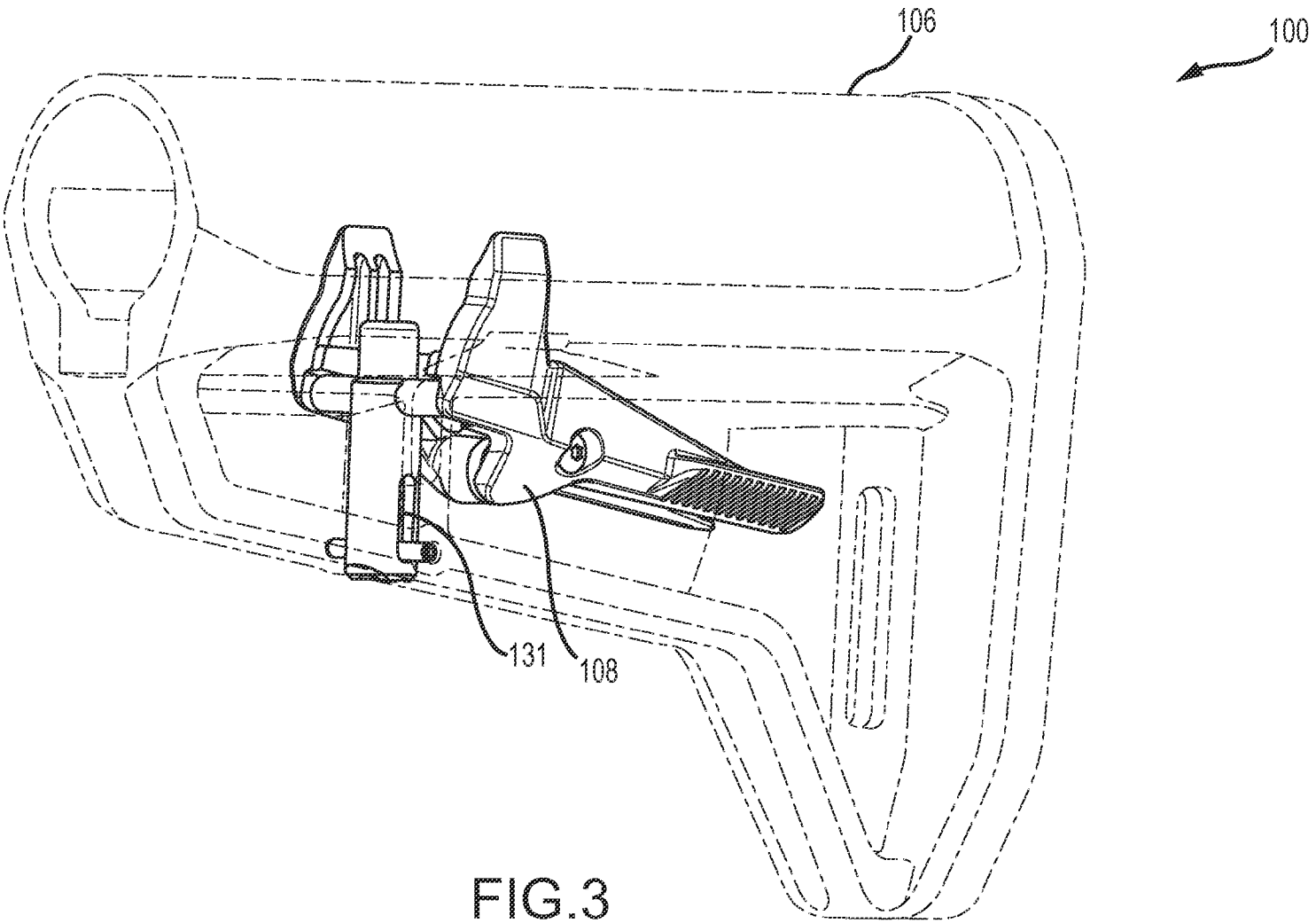
FIG. 3 is a perspective view of the stock assembly with a housing drawn transparently to illustrate some aspects of interior components in an engaged configuration.
Figure 4:
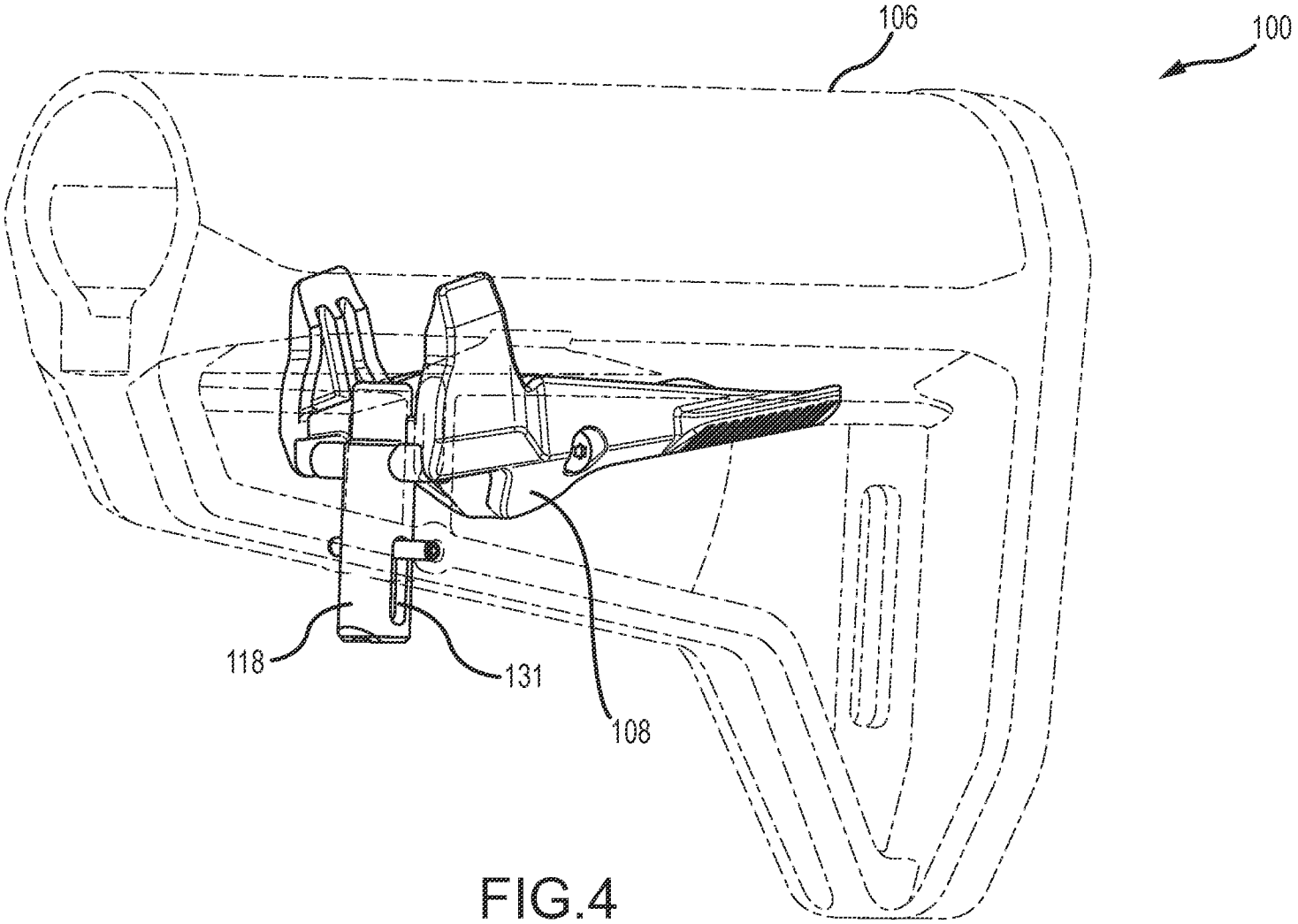
FIG. 4 is a perspective view of the stock assembly with a housing drawn transparently to illustrate some aspects of interior components in a disengaged configuration.

Referring now to FIGS. 3-4, the LOP adjustment mechanism 108 is movable between an engaged configuration, as illustrated in FIG. 3, and a disengaged configuration, as illustrated in FIG. 4. More specifically, while in the engaged configuration, the LOP adjustment mechanism 108 extends into the housing 106 to abut the receiver extension tube 202 (See FIG. 13) at multiple points, both to prevent the stock 100 from moving longitudinally relative to the receiver extension 200 (see FIG. 12) and to limit transverse movement or rattle between the stock 100 and the receiver extension 200.

The manner in which the LOP adjustment mechanism 108 engages or abuts the receiver extension 200 will be described in subsequent portions of this document. However, it will be of benefit to the reader to first independently describe the LOP adjustment mechanism 108 in further detail.

Figure 5:
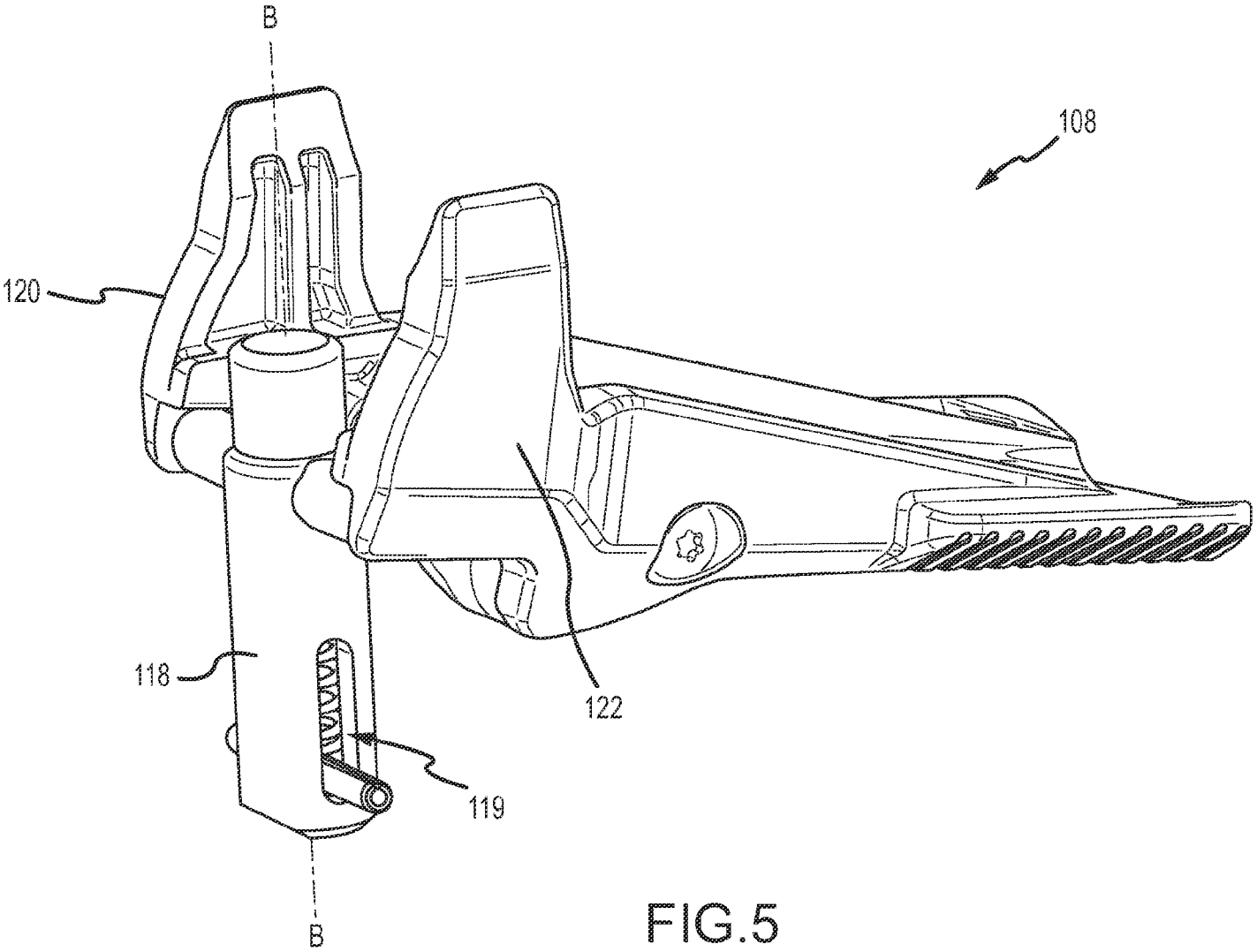
FIG. 5 is a perspective view illustrating aspects of a length of pull adjustment mechanism.
Figure 6:
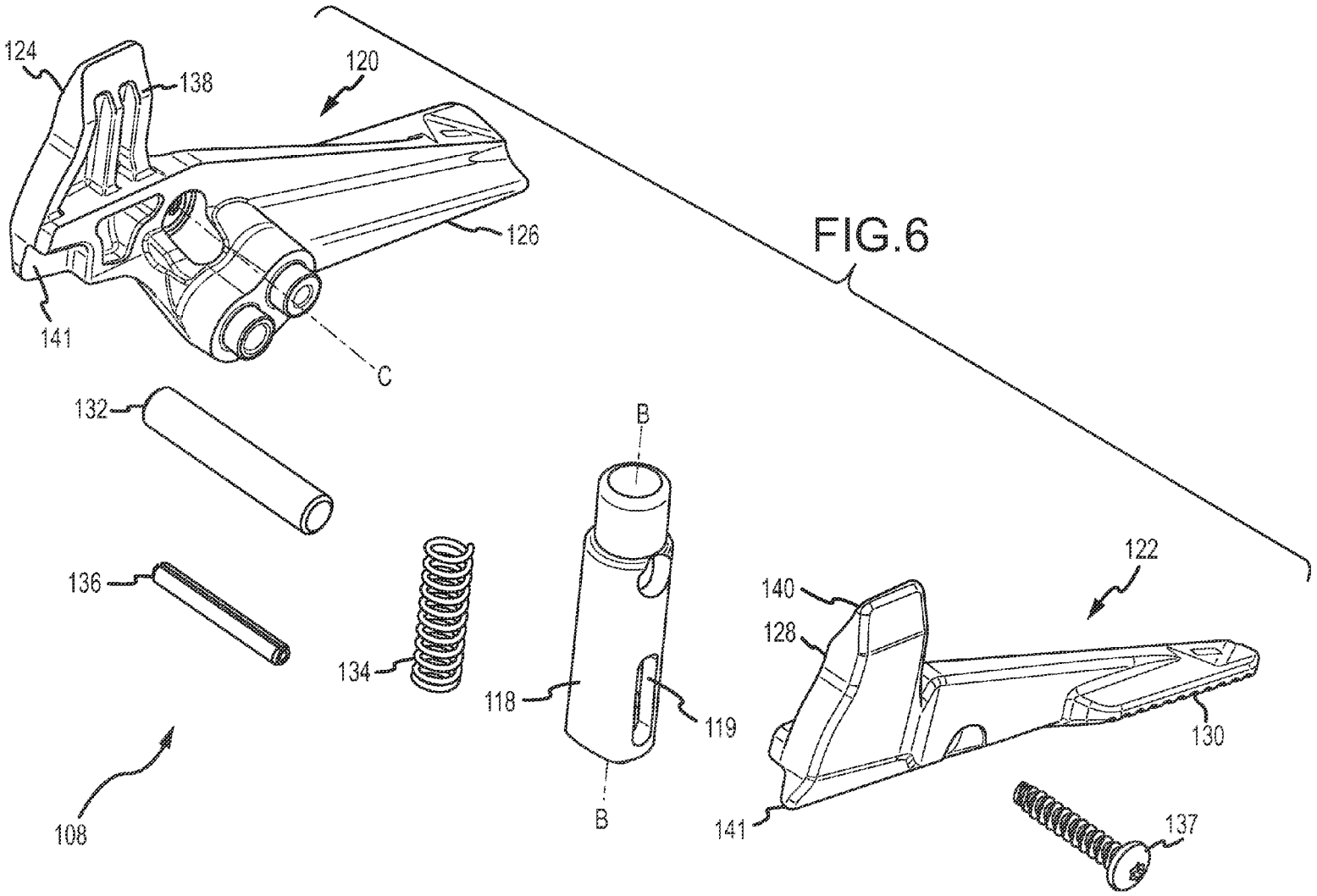
FIG. 6 is an exploded view of the length of pull adjustment mechanism in FIG. 5.
Figure 7:
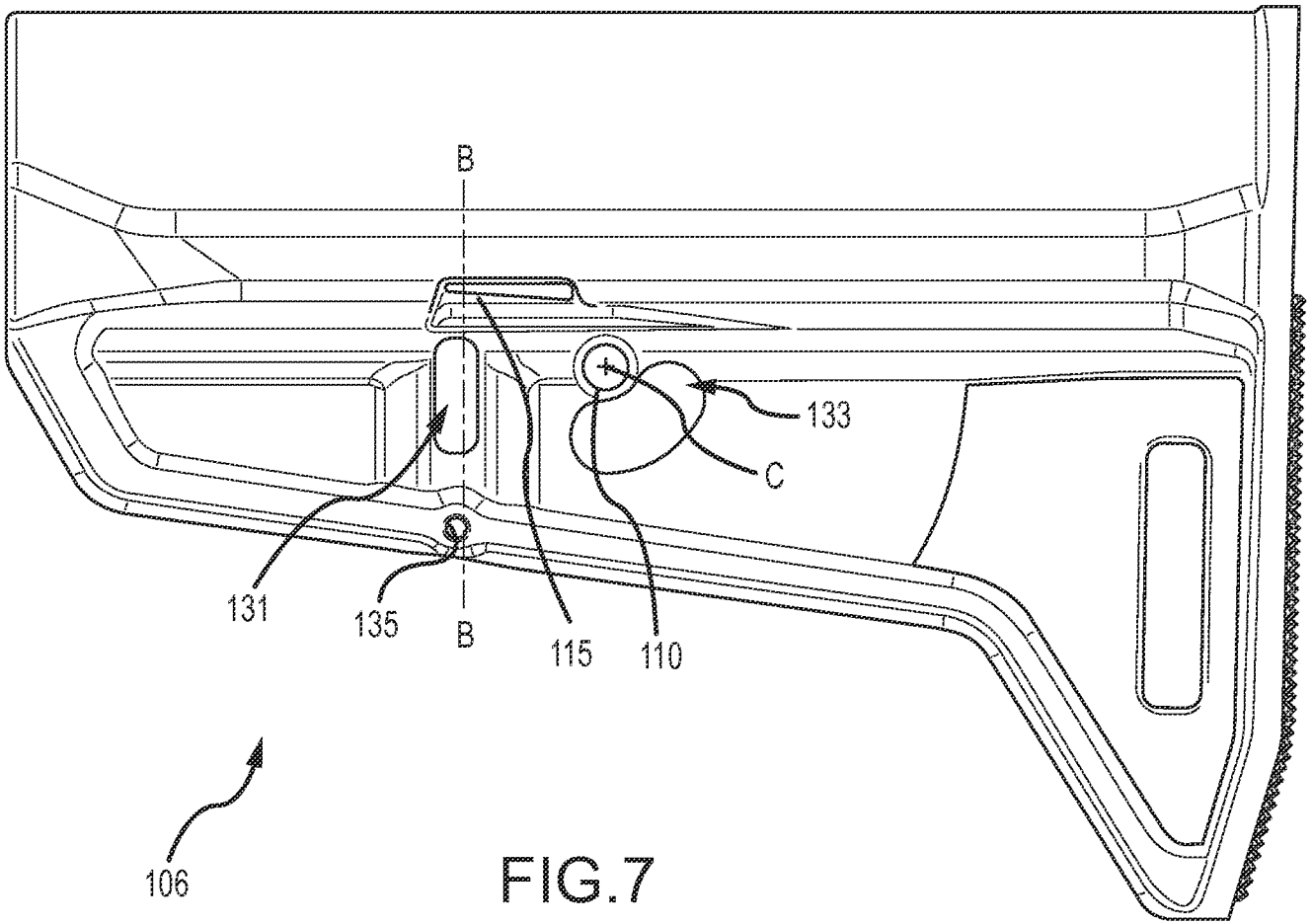
FIG. 7 is a side view illustrating some aspects of a housing.
Figure 8:
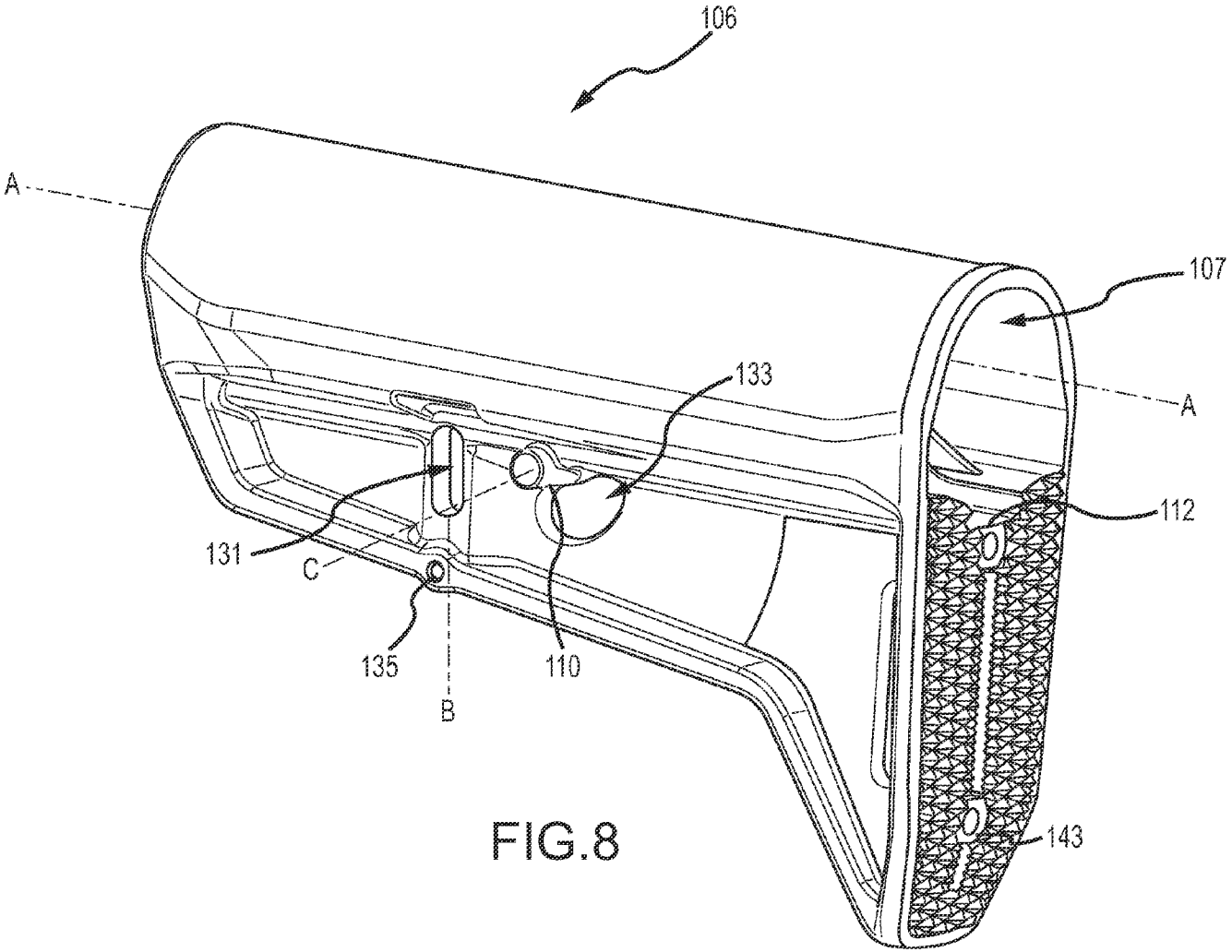
FIG. 8 is a rear perspective view of the housing.
Figure 9:
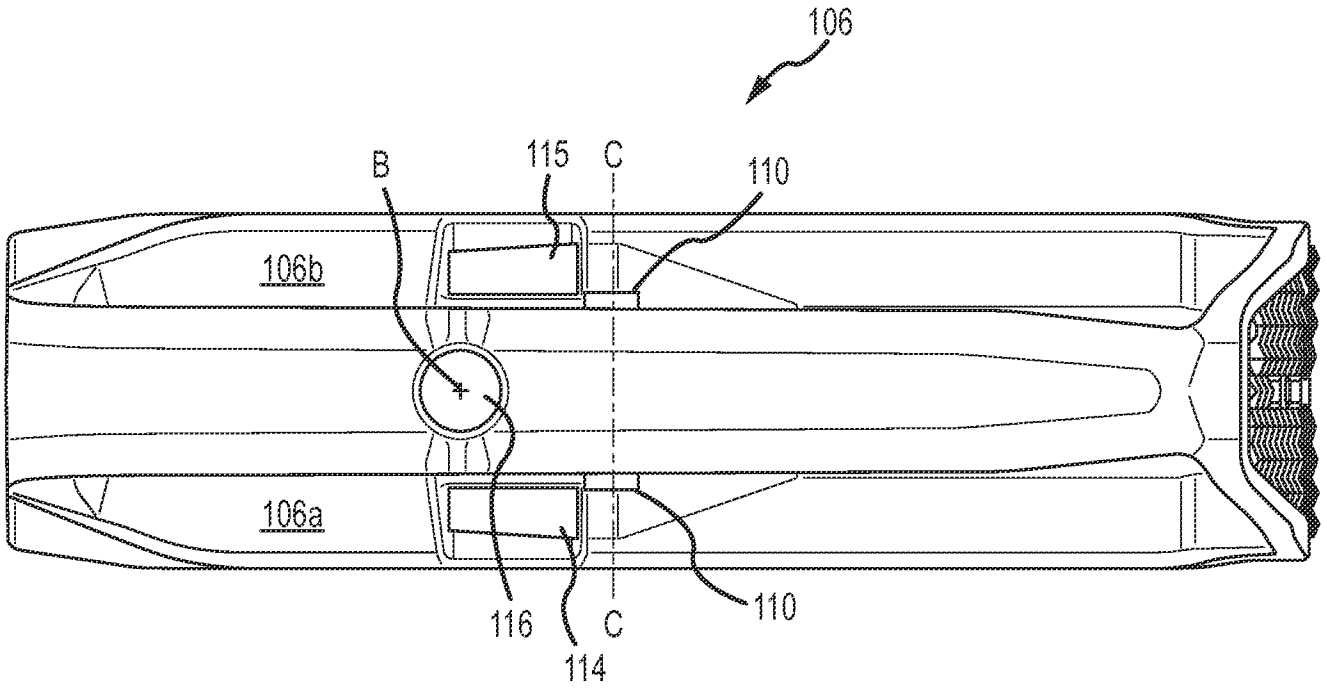
FIG. 9 is a bottom view of the housing.
Figure 10:
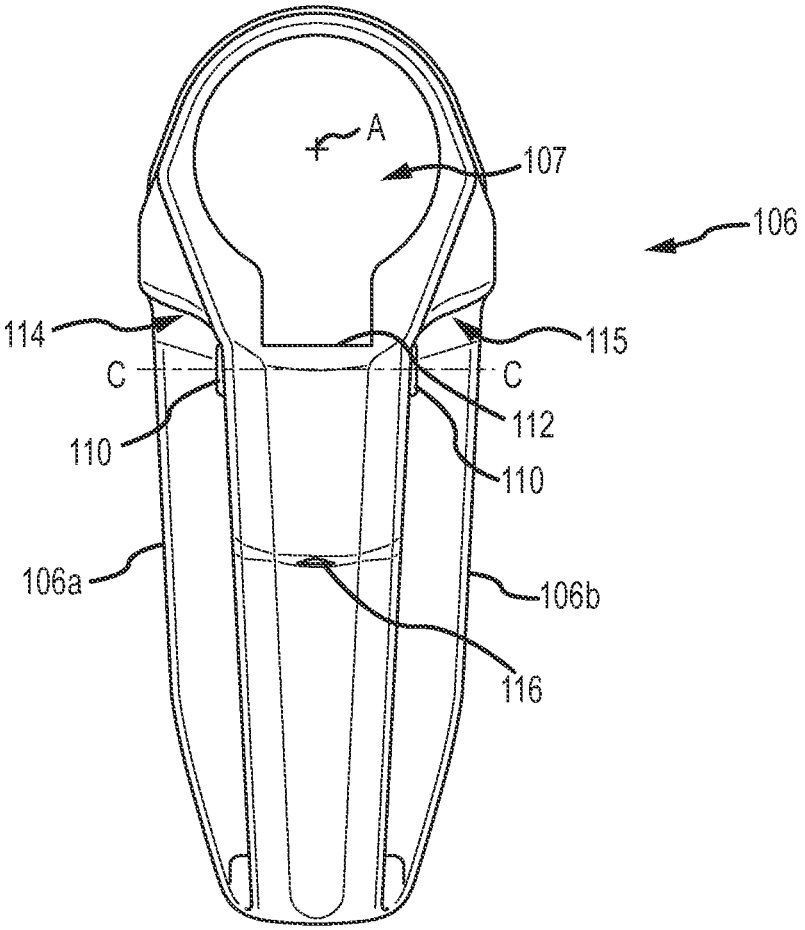
FIG. 10 is a front view of the housing.

The LOP adjustment mechanism 108, as illustrated in FIGS. 5-6 may include a first lever 120, a second lever 122, and a locating member 118. The locating member 118 may be coupled to the first and/or second levers 120, 122 such that the locating member 118 is limited to translational movement along a translational axis B while the first and/or second levers 120, 122 pivot about another axis C (see FIG. 6). Referring now to FIG. 6, this relationship in movement may be achieved using a transverse member 132 extending between the first and second levers 120, 122 and through the locating member 118. A spring 134 and a fastening member 136 may be inserted through a bottom portion of the locating member 118 and fixed to the housing 106 so as to bias the LOP adjustment mechanism 108 towards an engaged configuration. A fastener, such as a screw 137, may be used to attach the first and second levers 120, 122 together on opposing sides of the housing 106, such as through a lever passage 133. Although described herein as including two levers 120, 122, it should be understood that the LOP adjustment mechanism 108 may function as intended using a first lever 122 on one side and another support feature on another side that could engage the receiver extension 200 (see FIG. 12) and limit transverse movement of the stock 100 relative to the receiver extension 200.

In some embodiments, the transverse member 132 is a cylindrical pin without a notch. In some embodiments, a transverse member 132 that is a cylindrical pin without a notch and that is not press-fit through the locating member 118 is provided. A transverse member 132 without a notch and that is not press-fit, as illustrated, has not been possible using currently-available stocks having anti-rattle features (e.g., most stocks require a pin with a notch to the hold the pin in place), resulting in greater costs to manufacture those stocks that obtain a comparable feel of quality and durability.

Continuing with FIG. 6, the first lever 120 may have a first arm 124 and a second arm 126, with the first and second arms 124, 126 extending in different directions from a pivot axis C. Of note, in some embodiments, the housing 106 includes a transverse mount(s) 110 (see e.g. FIG. 7) to provide a pivot axis C about which the first and/or second levers 120, 122 may pivot. In some embodiments, the transverse mount(s) 110 may include a protrusion on one or both sides of the housing 106 as illustrated, although it will be understood by those of skill in the art that other means of providing a pivot axis C are contemplated. For example, a recess may be provided in one or both sides of the housing 106 and a protrusion that fits into the recess(s) may be provided in one or both of the levers 120, 122. In some embodiments, the first arm 124 may extend generally upwardly from the pivot axis C while the second arm 126 may extend generally proximally (towards a rear of the stock 100) from the pivot axis C, although it should be understood that the arms 124, 126 may extend in other directions to achieve the functional purposes for which the arms 124, 126 are provided. As just one example, the second arm 126 may extend generally downward to allow a user to pull on the arm 126 to cause the LOP adjustment mechanism 108 to move into the disengagement configuration. The second lever 122, where provided, may be configured and operated in a manner similar to the first lever 120. In some embodiments, the first arm 124 may extend generally upwardly and proximally while the second arm 126 may extend generally downwardly and proximally from the pivot axis C.

Continuing with FIG. 6, one or both of the first and second levers 120, 122 may include a curved surface 138, 140 at a distal end of the first arm(s) 124, 128, that is, at an end distal from the pivot axis C. Those skilled in the art will understand that, while the stock 100 will function using a straight surface at the distal end of the first arm(s) 124, 128, or any contact between the first arm(s) 124, 128 and the receiving components, a curved surface(s) 138, 140 may be used to maximize a contact surface with a receiving component such as a receiver extension tube 202 (see e.g. FIG. 14). For instance, the curved surface(s) 138, 140 may have a radius of curvature that is equal to or slightly greater than an outer radius of the receiver extension 200. Additionally, the second arm(s) 126, 130 of the first and/or second lever 120, 122 may have a handle-type shape for ease of operation by the user. In some embodiments, the second arm(s) 126, 130 may have a roughened or ribbed surface to prevent a user's hand from slipping off the lever(s) 120, 122.

In some embodiments, the LOP adjustment mechanism 108 provides for translational movement of the locating member 118 and pivoting movement of the lever(s) 120, 122. This relationship in movement may be achieved by providing a locating member 118 that is limited to movement along an axis B, such as by providing a locating member hole 116, which may be vertical, in the housing 106 along which the locating member 118 may translate (see e.g. FIGS. 9-10). To prevent the locating member 118 from slipping out of the housing 106, a fastening member 136 may be provided, extending through the locating member 118 and coupled to the housing 106, such as by pressing into a pin hole 135 of the housing 106 (see e.g. FIG. 8). A spring 134 may be included in the locating member 118 so as to bias the LOP adjustment mechanism 108 towards the engaged configuration. In some embodiments, a transverse member 132 is provided through the locating member 118 so as to translate forces between the lever(s) 120, 122 and the locating member 118, although it should be understood by those of skill in the art that the locating member 118 and the transverse member 132 could be provided as a single unit, for example, having a T-shape, which, while affecting manufacturing process to enable assembly, would still result in a functional design. It should also be understood that, although the locating member 118, transverse member 132, and fastening member 136 are illustrated as substantially cylindrical members, this is not a necessary feature to allow the stock 100 to function. The transverse member 132 may be press fit or otherwise affixed to the locating member 118 so that the transverse member 132 does not rotate relative to the locating member 118. In some embodiments, however, interior surfaces 141 of the first and second levers 120, 122 may be used to prevent the transverse member 132 from dislodging, allowing the transverse member 132 to rotate relative to the locating member 118 and roll relative to the levers 120, 122 as the stock is moved between the engaged and disengaged configuration. In short, a longitudinal axis of the transverse member 132 is generally fixed relative to the locating member 118, and the transverse member 132 may or may not be allowed to rotate relative to the locating member 118. It should also be understood that the first and second levers 120, 122 may be a single unit with each other, and possibly with the transverse member 132, with the housing 106 suitably modified to allow the unit to be installed.

Turning to FIGS. 7-11, the housing 106 is now described in further detail. The housing 106 may be made of a first half 106*a* and a second half 106*b* (see FIG. 9), which are then coupled together using means known in the art. In some embodiments, the housing 106 may be polymeric and made primarily using molding procedures with or without subsequent finishing operations. The housing 106 may provide mounting features for the LOP adjustment mechanism 108 (see FIG. 6), such as transverse mount(s) 110 on one or both sides of the housing 106 so as to provide a pivot axis C for the lever(s) 120, 122. Similarly, the housing 106 may provide a lever passage 133 through which portions of one or both of the lever(s) 120, 122 (see FIG. 6) and/or the screw 137 (see FIG. 13) or fastener may pass, so as to allow the lever(s) 120, 122 to be coupled together and operate in unison. It should be understood, however, that, instead of transverse mount(s) 110 and a lever passage 133 as illustrated, the lever passage 133 could be shaped so as to also provide the pivot axis C, although separating the lever passage 133 and the pivot axis C may allow for a simplification of the attachment mechanism between the two levers 120, 122.

Figure 11:
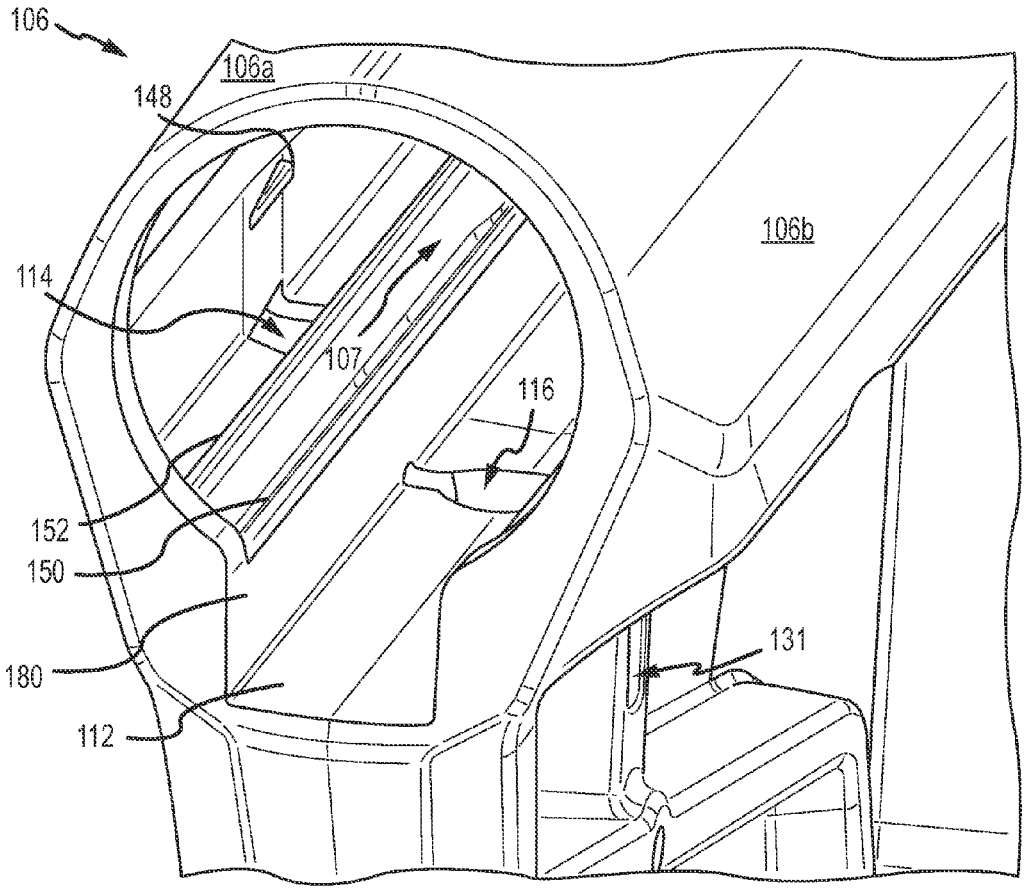
FIG. 11 is a detailed view illustrating some aspects of the housing.
Figure 12:
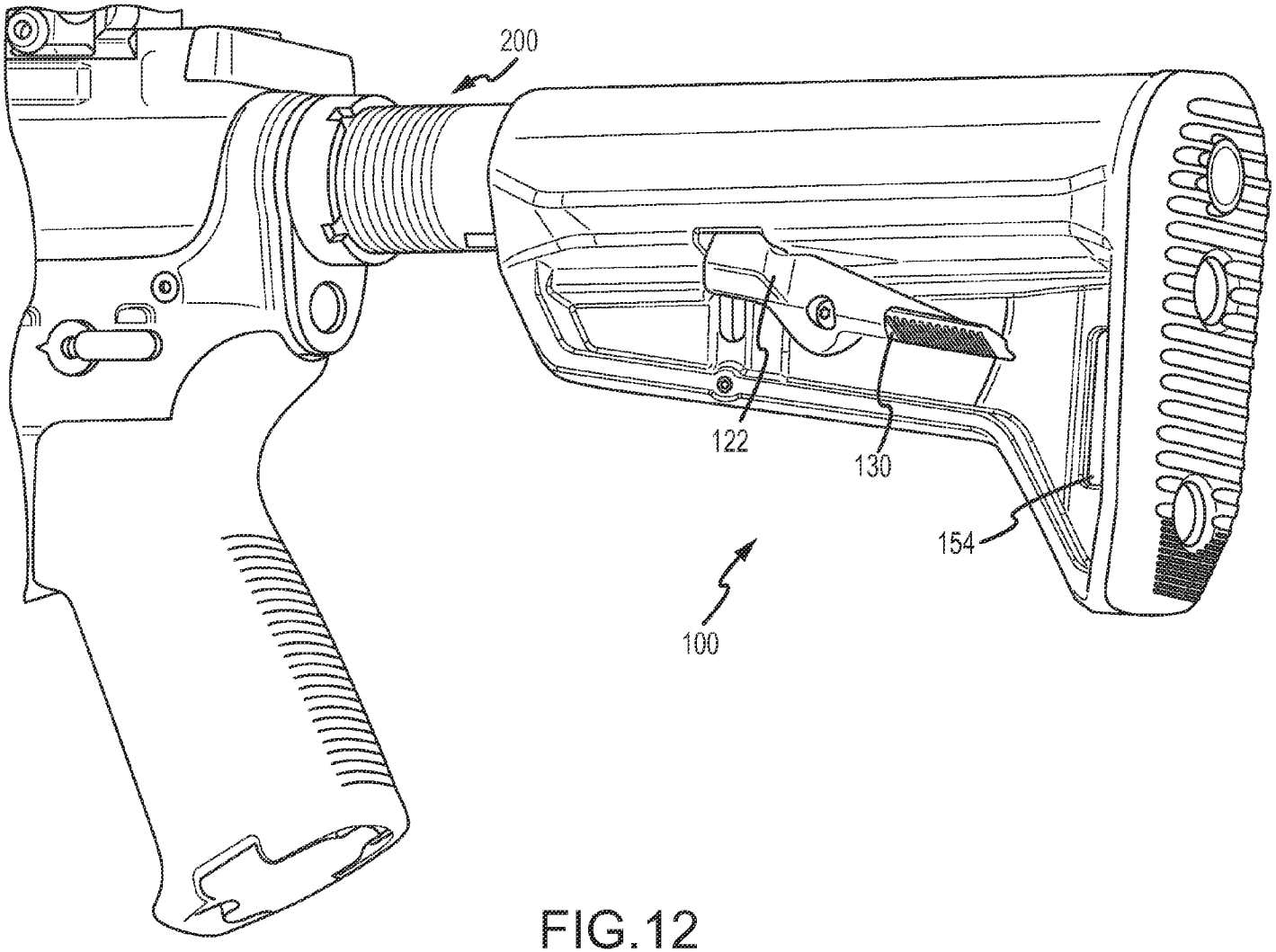
FIG. 12 is a perspective view illustrating a stock assembled to a firearm.

Continuing with FIGS. 7-11, the housing 106 may have a first lever arm entry 114 and/or a second lever arm entry 115 to allow the first arm 124, 128 of the first and/or second lever(s) 120, 122 to enter the housing 106 and move within the housing 106 in response to user manipulation of the second arm(s) 126, 130 (see FIG. 6), to selectively interface with the receiver extension 200 (see FIG. 12).

To provide further assembly and operation capabilities, the housing 106 may have a locating member hole 116 (see e.g. FIG. 9) that may define a translational axis B for the locating member 118. In some embodiments, the locating member hole 116 is circular and/or extends vertically. The locating member hole 116 may provide a manufacturer or user the ability to insert the locating member 118 for providing a biasing force to the lever(s) 120, 122 (see FIG. 6) and translating a pivoting motion of the lever(s) 120, 122 to a translational motion of the locating member 118. A fastening passage 135 may be provided to allow a user or manufacturer to insert a fastening member 136 (see e.g. FIG. 6), such as by using a press fit through the housing 106 and a sliding engagement through a slot 119 in the locating member 118, to maintain the locating member 118 assembled to the housing 106. The fastening member 136 may provide a bottoming surface for the spring 134 to bias the LOP adjustment mechanism 108 towards the engaged configuration.

It should be noted that a slot 131 may be provided in the housing 106 to allow the transverse member 132 to translate relative to the housing 106 (see e.g. FIGS. 3-4). The slot 131 may also provide a viewing window to give a user an indication of proper engagement with a receiver. Similarly, a length of the locating member 118 may be selected so as to extend below the housing 106 slightly to give the user an indication of engagement, as illustrated in FIG. 13 and/or to maximize the length of engagement between the housing 106 and the locating member 118, thereby improving the strength or stability of the stock 100.

Figure 13:
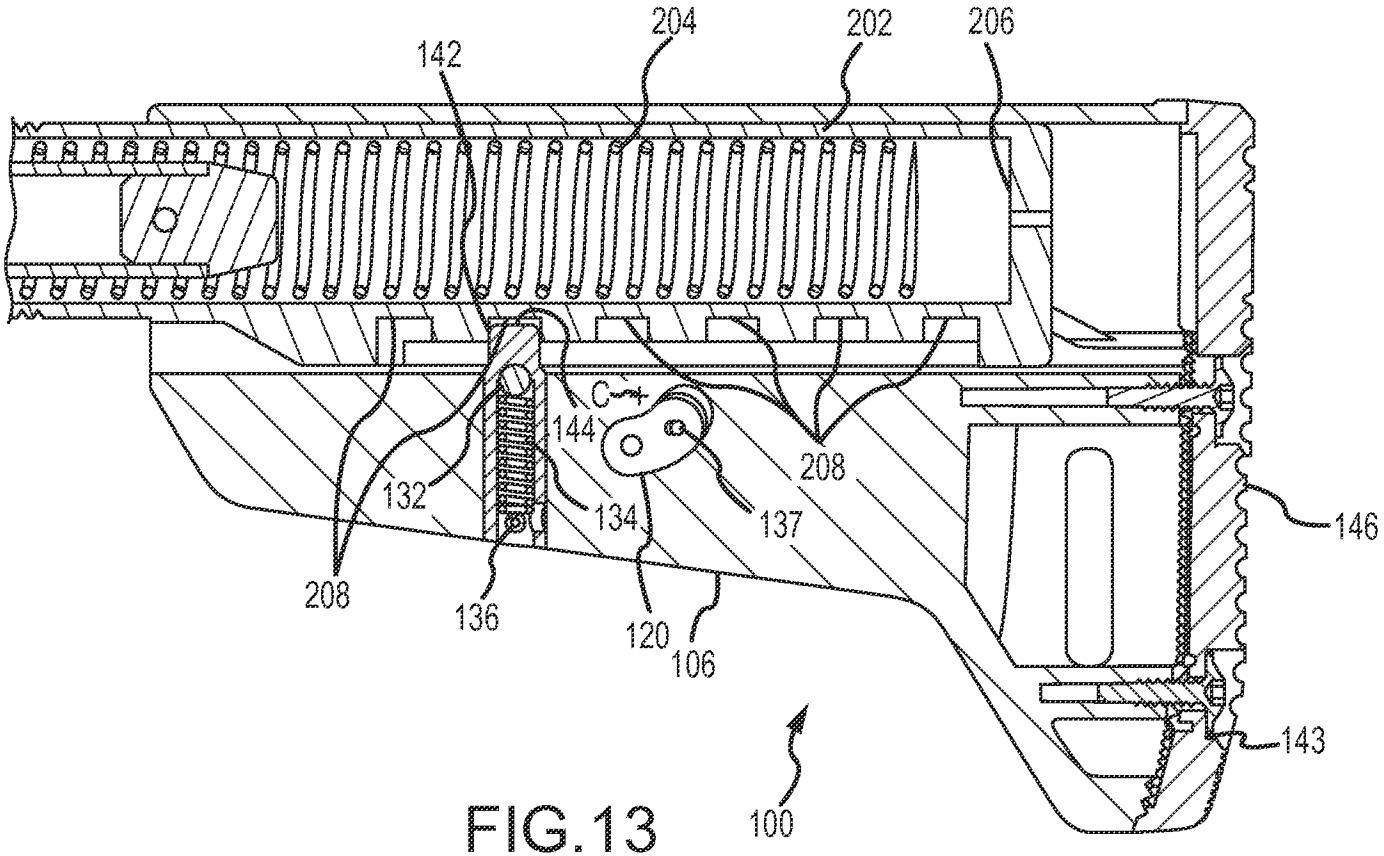
FIG. 13 is a side section view of the stock assembled to the firearm.

Continuing with FIGS. 7-11, it will also be understood by those of skill in the art that the housing 106 may provide mating features 143 for a butt plate 146, so that the user may attach a butt plate 146 after assembling the stock 100 to a receiver extension 200 (see e.g. FIG. 13 and/or to otherwise maintain the stock 100.

Continuing now with FIGS. 11-14, the interior of the passage 107 may provide a number of locating features for the receiver extension 200 and/or the LOP adjustment mechanism 108. The receiver extension track 112 and the rails 150, 152 (see FIG. 11) may assist in generally orienting the rotational placement of the receiver extension 200 and the stock 200 relative to one another, while the locating member hole 116 allows the LOP adjustment mechanism 108 to selectively engage the receiver extension 200 and limit longitudinal movement of the stock 100 relative to the receiver extension 200 (see e.g. FIGS. 13-14), as well as to provide some relative rotational limitation between the stock 100 and receiver extension 200. The lever arm entry or entries 114, 115 allow the lever(s) 120, 122 to engage the receiver extension 200 and precisely limit transverse movement of the stock 100 relative to the receiver extension 200, and, more specifically, reduce or eliminate rattling of the stock 100.

Turning now to FIG. 11, the housing 106 is illustrated with a plurality of rails 180, 150, 152 for generally limiting rotational movement of the stock 100 relative to the receiver extension 200. Specifically, the rail 112 may generally align the stock 100 to the firearm, while the other rails 150, 152 may generally provide a better fitment between the rounded sections of the firearm and the stock 100, as well as improved structural integrity with less material. However, those skilled in the art will understand that a single rail 180, (see e.g. FIG. 11) or other interface may be sufficient for the stock 100 to function as intended.

Figure 14:
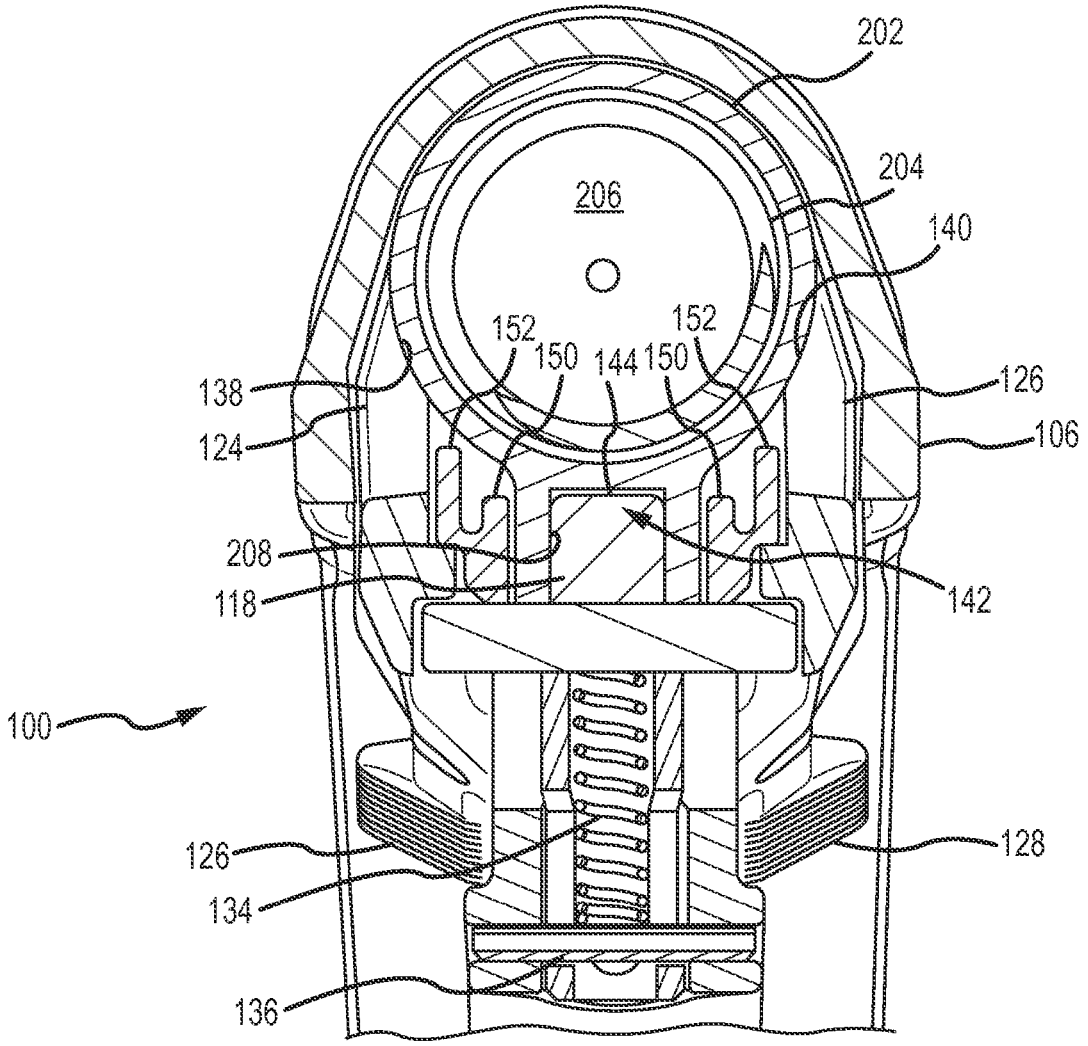
FIG. 14 is a front section view of the stock assembled to the firearm.

Turning now to FIG. 11 with simultaneous reference to FIG. 14, the housing 106 may have one or more inwardly extending protrusions 148. These protrusions 148 may be provided to limit the first arm(s) 124, 128 from flexing out too far during use. By providing these inwardly extending protrusions 148, the wall thickness of the housing 106 can be reduced to ensure a consistent cooling/hardening of a polymeric housing. Additionally, the inwardly extending protrusions 148 may provide a smaller surface area along which the first arm(s) 124, 128 may slide so as to limit friction between the LOP adjustment mechanism 108 and the housing 106 should the components contact.

The LOP adjustment mechanism 108 may abut the receiver extension 200 at multiple points to limit longitudinal, rotational, and transverse movement of the stock 100 relative to the receiver extension 200; these points are illustrated most clearly in FIGS. 13-14, which, together illustrate three regions of contact to limit or eliminate relative movement or rattle. See e.g. the top surface 144 to recess 208 interface in FIG. 13, and the curved surfaces 138, 140 to extension tube 202 interfaces in FIG. 14. As illustrated, the stock 100 is assembled to a receiver extension 200, sometimes referred to as a buffer tube assembly, that generally includes a spring 204 and a receiver extension tube 202 with a rear portion 206 and a plurality of recesses 208. Those skilled in the art will understand that the receiver extension 200 will also include a number of other components not addressed herein for clarity.

Of particular relevance to the stock 100 disclosed herein, the receiver extension tube 202 includes a plurality of recesses 208 that are positioned so as to allow a user to selectively engage any of the recesses 208 to adjust the length of pull of the firearm. Substantially simultaneously with a movement of the locating member 118, the arm(s) 124, 126 move to engage the receiver extension tube **20*b* along a curved surface(s) 138, 140 of the arm(s) 124, 126**.

The locating member 118 is configured and shaped such that a top portion 142 of the locating member 118 is biased towards engagement within the recess(es) 208 by extending into a respective recess 208 selected by a user. A close view of FIG. 14 will reveal that, generally, the curved surface(s) 138, 140 of the lever(s) 120, 122 and the locating member 118 are sized such that the curved surface(s) 138, 140 will contact or bottom out against the receiver extension tube 202, and prevent the top surface 144 of the locating member from bottoming out in the recess 208. Those of skill in the art will understand that allowing the locating member 118 to bottom out first would increase the amount of give between the stock 100 and the receiver extension 200, although the stock 100 would still function with less accuracy.

By providing a LOP adjustment mechanism 108 that limits longitudinal movement using a locating member 118 while limiting transverse movement using arm(s) 138, 140, the Applicants enable a manufacturer to produce an inexpensive stock 100 that still provides for tight tolerancing between the stock 100 and a receiver extension 200 that is comparable to the tolerances normally associated with heavier and/or more expensive stocks. That is, a stock 100 built as disclosed herein may provide a sense of quality attained to date with much more expensive stocks.

Continuing with FIGS. 13-14, it is noted that the LOP adjustment mechanism 108 may be configured to properly function regardless of whether the associated receiver extension 200 is at a minimum tolerance stack-up or a maximum tolerance stack-up. That is, the LOP adjustment mechanism 108 may be configured to always cause the lever(s) 120, 122 to abut or bottom out against the receiver extension 200 even if the receiver extension is at the minimum tolerance stack-up. Simultaneously, the LOP adjustment mechanism 108 may be configured to always fully disengage from the receiver extension 200, even when the receiver extension 200 is at the maximum tolerance stack-up. The LOP adjustment mechanism 108 may also be configured to prevent accidental disengagement from the firearm even with the receiving components of the firearm are at a maximum tolerance stack-up.

Figure 15:
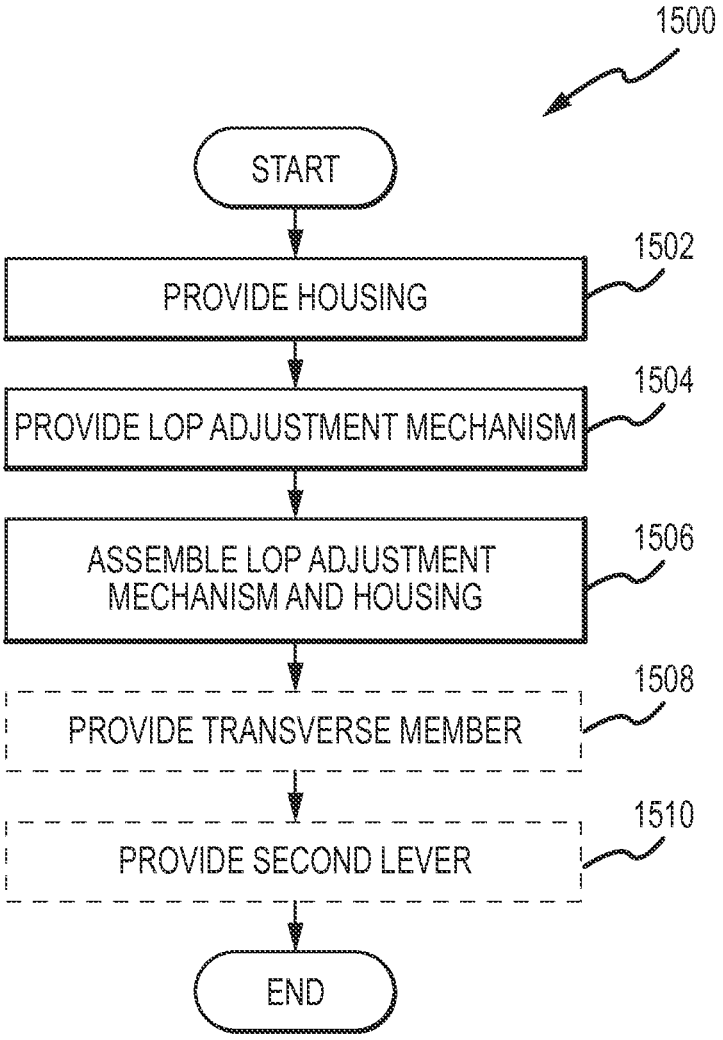
FIG. 15 is a flowchart of a method.

Turning now to FIG. 15, a method 1500 of making a stock for a firearm is now described. The method 1500 includes providing a housing 1502, providing a LOP adjustment mechanism 1504, and assembling 1506 the LOP adjustment mechanism and the housing.

Providing a housing 1502 includes providing a housing including a passage along a longitudinal axis, the passage shaped to slidingly engage a receiver extension of a firearm and having a lower portion with a receiver extension track, a locating member hole, and a first lever arm entry. Providing a housing 1502 may be achieved by providing a housing 106 as described with reference to FIGS. 1-14 of this document.

Providing a LOP adjustment mechanism 1504 includes providing a length of pull adjustment mechanism including a locating member and a first lever having a first arm shaped to abut the receiver extension and a second arm. Providing a LOP adjustment mechanism 1504 may be achieved by providing a LOP adjustment mechanism 108 as described with reference to any of FIGS. 1-14 of this document.

Assembling 1506 includes assembling the housing and the length of pull adjustment mechanism such that: (a) the locating member is translatable along an axis of the locating member hole; (b) the first arm of the first lever extends through the first lever arm entry and into the passage to abut a receiver extension; (c) the second arm of the first lever extends in a different direction from a lever pivot axis; (d) the length of pull adjustment mechanism is biased towards an engaged configuration wherein a top portion of the locating member protrudes into the passage and the first arm is in a receiver engagement position; and (e) the length of pull adjustment mechanism is movable to a disengaged configuration wherein the locating member is translated such that the upper portion does not protrude into the passage, and the first arm is pivoted into a receiver disengagement position. Assembling 1506 may be achieved by assembling the housing 106 and the LOP adjustment mechanism 108 as described with reference to FIGS. 1-14 of this document.

In some embodiments, the method 1500 may include providing a transverse member 1508 and/or providing a second lever 1510, either or both of which may be achieved using the transverse member 132 and/or the second lever 122 described with reference to FIGS. 1-14 of this document, and assembling the transverse member 132 and/or the second lever 122 as previously illustrated and described herein.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A stock for a firearm, comprising:

a proximal end shaped to allow a user to brace the stock;

a distal end shaped to interface with a firearm;

a longitudinal axis fixed by a firing direction of the stock and extending between the proximal end and the distal end of the stock;

a housing including a firearm mounting space along the longitudinal axis, the mounting space shaped to slidingly engage a receiving component of the firearm, the housing having a lower portion with at least one rail, a locating member hole, and a first lever arm entry; and a length of pull adjustment mechanism; wherein the length of pull adjustment mechanism:

a) includes a locating member translatable along an axis of the locating member hole in the housing;

b) includes a first lever having a first arm extending from a lever pivot axis through the first lever arm entry and into the mounting space and a second arm extending in a different direction from the lever pivot axis, the first arm shaped to abut the receiving component of the firearm;

c) is biased towards an engaged configuration wherein a top portion of the locating member protrudes into the mounting space and the first arm is in an engagement position wherein a portion of the first arm abuts the receiving component; and d) has a disengaged configuration wherein the locating member is translated such that the upper portion does not protrude into the mounting space, and the first arm is pivoted away from the receiving component and into a disengagement position.

2. The stock of claim 1, wherein:

the first arm of the first lever includes a distal portion having a curved surface shaped to engage the receiving component of the firearm.

3. The stock of claim 1, wherein:

the housing comprises a protrusion shaped and positioned to limit outward flexure of a distal portion of the first arm when the first lever is in the engagement position.

4. The stock of claim 1, further comprising:

a transverse member extending between the locating member and the first arm, the transverse member slidingly engaged with the first arm.

5. The stock of claim 4, wherein:

the stock comprises a second lever opposing the first lever, the second lever configured to abut the receiving component of the firearm when in an engaged position;

the transverse member is a cylindrical pin without a notch; and interior surfaces of the first lever and the second lever limit the transverse member from sliding relative to the locating member when the first lever and the second lever abut the receiving component of the firearm.

6. The stock of claim 4, further comprising:

a second lever having a first arm and a second arm, the second lever opposing the first lever and configured to abut the receiving component of the firearm when in an engaged position; wherein the transverse member extends between the first arm of the second lever and the first arm of the first lever, the transverse member slidingly engaged with the first arm of the second lever and the first arm of the first lever.

7. The stock of claim 1, wherein:

the receiving component of the firearm is manufactured within a minimum tolerance stack-up and a maximum tolerance stack-up;

a distal end of the first arm is configured to abut the receiving component when the length of pull adjustment mechanism is in the engaged configuration and the receiving component has the minimum tolerance stack-up;

the distal end of the first arm is configured to disengage from the firearm when the length of pull adjustment mechanism is in the disengaged configuration and the receiving component has the maximum tolerance stack-up.

8. The stock of claim 1, wherein:

the distal end of the first arm and the locating member are configured to prevent unintentional disengagement when the receiving component has a maximum tolerance stack-up.

9. A stock for a firearm, comprising:

a proximal end shaped to allow a user to brace the stock;

a distal end shaped to interface with a firearm of a firearm;

a longitudinal axis fixed by a firing direction of the stock and extending between the proximal end and the distal end;

a housing including a mounting space along the longitudinal axis, the mounting space shaped to slidingly engage a receiving component of the firearm; and a length of pull adjustment mechanism movable between an engaged configuration and a disengaged configuration, wherein the length of pull adjustment mechanism comprises a locating member and a first stabilizer arm, the first stabilizer arm movable between an engaged position when the length of pull adjustment mechanism is in the engaged configuration and a disengaged position when the length of pull adjustment mechanism is in the disengaged configuration, the first stabilizer arm shaped to abut the receiving component of the firearm and limit transverse movement of the stock relative to the receiving component of the firearm when the length of pull adjustment mechanism is in the engaged configuration, the first stabilizer arm further shaped to cause the locating member to move between a first position when the length of pull adjustment mechanism is in the engaged configuration and a second position when the length of pull adjustment mechanism is in the disengaged configuration, the locating member shaped to engage a recess in the receiving component of the firearm when the length of pull adjustment mechanism is in the engaged position to select a length of pull.

10. The stock of claim 9, further comprising:

a second stabilizer arm coupled to and opposing the first stabilizer arm and coupled to the locating member; wherein movement between the engaged configuration and the disengaged configuration causes the first stabilizer arm and the second stabilizer arm to pivot and the locating member to translate.

11. The stock of claim 9, wherein:

the length of pull adjustment mechanism is biased towards the engaged configuration.

12. The stock of claim 9, wherein:

as the length of pull adjustment mechanism is moved from the disengaged configuration to the engaged configuration, a distal end of the first stabilizer arm and a distal end of the second stabilizer arm are shaped to bottom out against the receiving component of a firearm attached to the stock before the locating member bottoms out against the firearm.

13. The stock of claim 9, further comprising:

a transverse member extending from the locating member and engaging the first stabilizer arm and the second stabilizer arm; wherein a longitudinal axis of the transverse member is fixed relative to the locating member.

14. A method of manufacturing a stock for a firearm, comprising:

providing a housing including a mounting space along a longitudinal axis, the housing shaped to slidingly engage a receiving component of a firearm and having a lower portion with a rail, a locating member hole, and a first lever arm entry; and providing a length of pull adjustment mechanism; wherein the length of pull adjustment mechanism includes a locating member and a first lever having a first arm shaped to abut the receiving component of the firearm and a second arm; and assembling the housing and the length of pull adjustment mechanism such that:

a) the locating member is translatable along an axis of the locating member hole;

b) the first arm of the first lever extends through the first lever arm entry and into the mounting space;

c) the second arm of the first lever extends from a transverse lever pivot axis in a direction different from the first arm;

d) the length of pull adjustment mechanism is biased towards an engaged configuration wherein a top portion of the locating member protrudes into the mounting space and the first arm is in an engagement position; and e) the length of pull adjustment mechanism is movable to a disengaged configuration wherein the locating member is translated such that the upper portion does not protrude into the mounting space, and the first arm is pivoted into a disengagement position.

15. The method of claim 14, further comprising:

providing the first arm of the first lever with a distal portion having a curved surface shaped to engage the receiving component of the firearm.

16. The method of claim 14, further comprising:

providing the housing with a protrusion shaped and positioned to limit outward flexure of a distal portion of the first arm when the length of pull adjustment mechanism is in the engaged configuration.

17. The method of claim 14, further comprising:

providing a transverse member extending between the locating member and the first arm, the transverse member engaged with the first arm and pivotally or fixedly engaged with the locating member.

18. The method of claim 14, wherein:

providing the length of pull adjustment mechanism includes providing a length of pull adjustment mechanism that is configured to prevent accidental disengagement when the receiving component of the firearm is at a maximum tolerance stack-up.

19. The method of claim 14, further comprising:

providing a second lever opposing the first lever;

providing a transverse member extending through the locating member and engaging the first lever and the second lever; and fixing a longitudinal axis of the transverse member relative to the locating member.

20. The method of claim 14, wherein:

providing the housing includes providing the housing with a transverse mount for limiting the first lever to pivotal motion.

* * * * *